US010920471B2

(12) United States Patent
Hall

(10) Patent No.: US 10,920,471 B2
(45) Date of Patent: Feb. 16, 2021

(54) SELECTIVE TWO-WAY HINGE ASSEMBLY

(71) Applicant: KINGSWAY ENTERPRISES (UK) LIMITED, Swanley (GB)

(72) Inventor: Benjamin Hall, Swanley (GB)

(73) Assignee: Kingsway Enterprises (UK) Limited, Kent (GB)

( * ) Notice: Subject to any disclaimer, the term of this patent is extended or adjusted under 35 U.S.C. 154(b) by 266 days.

(21) Appl. No.: 15/977,392

(22) Filed: May 11, 2018

(65) Prior Publication Data

US 2018/0328089 A1 Nov. 15, 2018

(30) Foreign Application Priority Data

May 15, 2017 (GB) ..... 1707757

(51) Int. Cl.
*E05D 3/08* (2006.01)
*E05D 7/00* (2006.01)
*E05D 11/10* (2006.01)

(52) U.S. Cl.
CPC ..... *E05D 3/08* (2013.01); *E05D 7/009* (2013.01); *E05D 11/1014* (2013.01); *E05Y 2600/45* (2013.01); *E05Y 2600/46* (2013.01); *E05Y 2900/132* (2013.01)

(58) Field of Classification Search
CPC ..... E05D 3/08; E05D 11/1014; E05D 11/06
See application file for complete search history.

(56) References Cited

U.S. PATENT DOCUMENTS

| | | | | |
|---|---|---|---|---|
| 2,126,127 | A | 8/1938 | Mitchell | |
| 4,928,350 | A | 5/1990 | Morgan | |
| 6,109,711 | A | 8/2000 | Hoffman | |
| 6,170,210 | B1 | 1/2001 | Marts | |
| 8,671,521 | B2 * | 3/2014 | Irwin | E05D 3/12 16/308 |

(Continued)

FOREIGN PATENT DOCUMENTS

| | | |
|---|---|---|
| EP | 0801197 A1 | 10/1997 |
| FR | 2583096 A1 | 6/1985 |

(Continued)

OTHER PUBLICATIONS

Great Britain Patent Application 17007757.9 Examination Report dated Jun. 28, 2018.

(Continued)

*Primary Examiner* — Gregory J Strimbu
(74) *Attorney, Agent, or Firm* — Erise IP, P.A.

(57) ABSTRACT

A door mounting system comprises a hinge assembly (101) and a door frame (5), the length of the hinge assembly (101) corresponding to a height of the door frame (5). The hinge assembly (101) comprises a first hinge member (2) coupled to the door frame (5), an intermediate hinge member (3), and a second hinge member (4) for attachment to a door leaf (1). The first hinge member (2) and the intermediate hinge member (3) are rotatably coupled to each other around a first hinge axis, and the second hinge member (4) and the intermediate hinge member (3) are rotatably coupled to each other around a second hinge axis. A locking element is adapted to selectively inhibit rotation of the intermediate hinge member (3) relative to either the first hinge member (2) or the second hinge member (4).

20 Claims, 5 Drawing Sheets

(56) References Cited

U.S. PATENT DOCUMENTS

| | | | | |
|---|---|---|---|---|
| 9,187,940 | B2 * | 11/2015 | Chandler | E05D 3/08 |
| 2003/0101539 | A1 * | 6/2003 | Fang | E05D 3/08<br>16/302 |
| 2008/0289147 | A1 * | 11/2008 | Falato | E05D 3/12<br>16/382 |
| 2013/0000203 | A1 * | 1/2013 | Platt | E05D 3/08<br>49/246 |
| 2013/0099643 | A1 | 4/2013 | Kromrey et al. | |
| 2013/0219664 | A1 * | 8/2013 | Burda | E05D 11/06<br>16/374 |
| 2018/0044970 | A1 * | 2/2018 | Hall | E05C 19/002 |
| 2019/0300142 | A1 * | 10/2019 | Helsley | B64C 1/1407 |

FOREIGN PATENT DOCUMENTS

| | | | |
|---|---|---|---|
| GB | 28442 | A | 12/1909 |
| GB | 2478643 | A | 9/2011 |
| GB | 2508966 | A | 6/2014 |
| JP | 10227180 | A | 8/1998 |

OTHER PUBLICATIONS

Great Britain Patent Application 17007757.9 Search Report dated Jan. 25, 2018, 5 pages.

* cited by examiner

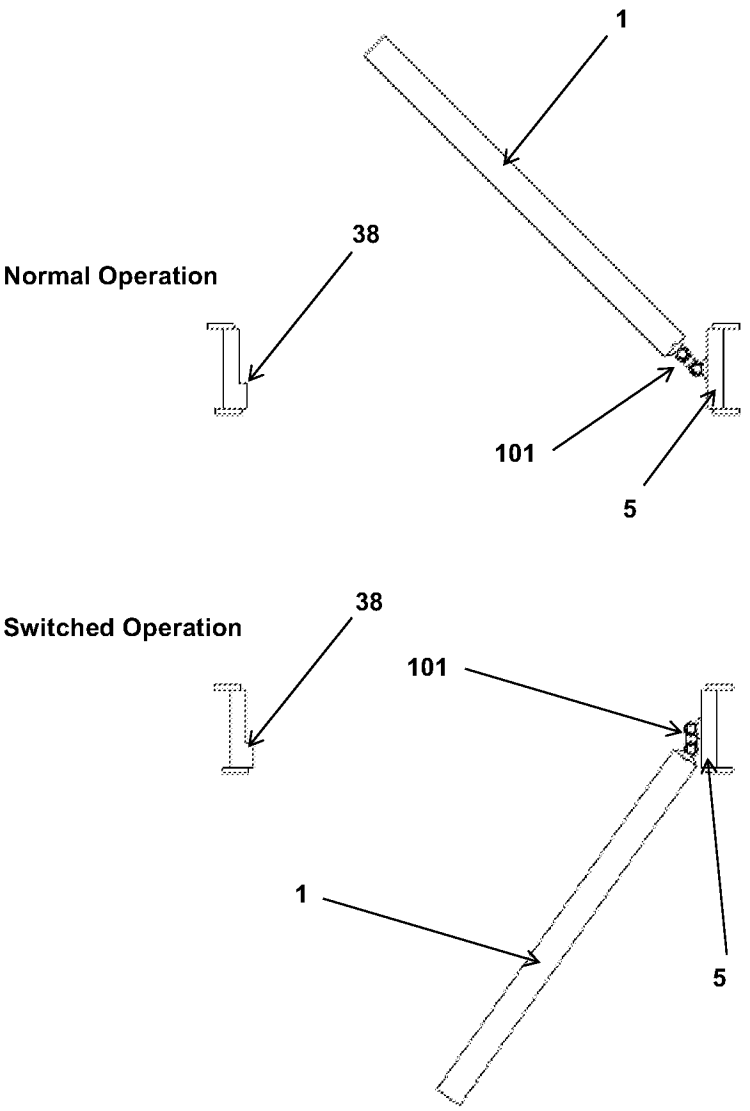
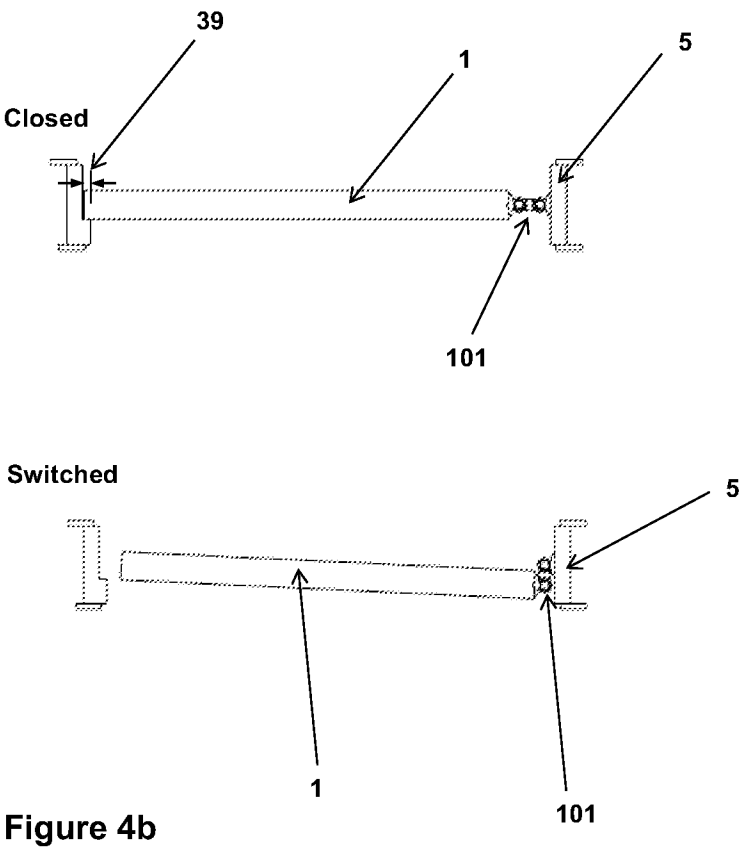
Figure 4a
Figure 4b

SELECTIVE TWO-WAY HINGE ASSEMBLY

RELATED APPLICATION

This application claims priority, with respect to all common subject matter, to Great Britain Patent Application No. 1707757.9, filed May 15, 2017, the disclosure of which is incorporated herein by reference in its entirety.

FIELD

The present disclosure relates to the provision of hinge systems and door assemblies comprising hinge systems. In particular, it relates to a hinge system which enables selective two way operation of a door around the hinge.

BACKGROUND

Conventional door designs facilitate opening either inwardly or outwardly, depending on practical convenience. For example, it may be considered undesirable for a door from a private area to open outwardly into a public area (such as a corridor) due to the risk that movement of passers-by in the public area may be impeded by a door opened within it.

However, in some circumstances there is a need for doors which can in exceptional circumstances open in an unorthodox direction. For example, in mental health institutions, patients who are vulnerable will often be provided with their own individual rooms off a corridor. In normal use, these doors will open inwardly into the patients' rooms. On occasion, there may be a need for health professionals to access the room when this mode of operation has been inhibited; for example, a patient may barricade themselves into the room but require immediate attention. In these cases, there is a need to overcome the fact that the door will not open in its usual direction. Similar situations may arise, for example, in case of fire or in store rooms where a large item may accidently fall against a door.

To resolve this issue, hinge assemblies which enable opening both inwardly and outwardly may be provided. To avoid opening in an undesired direction in normal use, a door jamb may be provided to inhibit rotation beyond a closed position in general operation. Mechanisms have been proposed to remove the door jamb in case of emergency, thus allowing the door to open in a direction opposite to its usual mode of operation. However, in some circumstances this solution has been considered unsatisfactory. For example, the door jamb is located distal to the hinge and thus at the point of greatest travel of the door during opening. Removal of the door jamb may leave operators feeling vulnerable to sudden opening of the door and potential physical injury.

One proposed solution to this issue has been described in United Kingdom patent application GB 2509326. According to this approach, an additional hinge axis is provided allowing multiple sections of the door to rotate relative to one another, effectively foreshortening the door so that it can pass beyond the doorjamb.

The approach comprises a door frame and a leaf hingedly mounted in the frame so as to be openable in a first direction, wherein the hinged mounting of the door is on a doorpost mounted to be pivotable relative to the frame about an axis parallel to and spaced from the hinged mounting of the door. The pivotable doorpost has a vertical pivoting axis passing through the central part of the doorpost, with coaxial pivoting connectors at its upper and lower ends engaging respectively with a top section of the doorframe and with the floor.

To selectively prevent foreshortening of the door in normal use, a pair of coaxial rods, located in the doorpost, are operable to slide towards and away from one another to engage respectively with a bore in a base plate and corresponding bore in the top of the door frame, thereby locking the door post pivotable movement.

There are various problems with such an approach.

The doorpost is only connected to the floor and the top of the door frame. These two points of contact often do not provide enough strength to prevent the doorpost from being knocked out of position.

The institutions or facilities that wish to install such a door often require minimal change to the existing door frame, i.e. that the retrofitting of the doorway involves minimal alteration. The use of base plates and coaxial rods that engage with the floor and top of the door frame, along with a door post that also needs connection with the floor and top of the doorframe does not meet the ease of retrofitting that these institutions and facilities are looking for.

Moreover, the approach requires a stop on the door jamb that is required in a non-standard location. This makes retrofitting the existing door frame impossible.

Therefore, there remains a need for an arrangement to facilitate selective opening of a door against its usual direction of operation in particular circumstances, that addresses the problems identified above.

SUMMARY

According to a first aspect, there is provided a door mounting system, comprising

- a hinge assembly and a door frame, wherein a length of the hinge assembly corresponds to a height of the door frame, the hinge assembly comprising:
- a first hinge member coupled to the door frame;
- an intermediate hinge member, wherein the first hinge member and the intermediate hinge member are rotatably coupled to each other around a first hinge axis;
- a second hinge member for attachment to a door leaf, wherein the second hinge member and the intermediate hinge member are rotatably coupled to each other around a second hinge axis; and
- a locking element adapted to selectively inhibit rotation of the intermediate member relative to either the first hinge member or the second hinge member.

This aspect can provide a system which enables selective rotation of part of the hinge assembly. The locking element may prevent rotation when engaged; in some examples this can prevent a door leaf coupled to the hinge assembly passing beyond a door jamb. When the locking element is disengaged it may be possible to rotate part of the hinge assembly and consequently move any coupled door leaf laterally; this may allow the door leaf to clear the door jamb and consequently open in a direction not otherwise available. The first position may correspond to a position in which a door leaf coupled to the first hinge member is closed.

The locking element may directly or indirectly couple the first or second hinge members to the intermediate hinge member. The locking element may be adapted such that inhibition of relative rotational movement of the first/second hinge member relative to the intermediate hinge member does not inhibit absolute movement of the intermediate hinge member.

The functionality of the system may be provided reliably, securely and discreetly. In particular, there may be minimal scope for an individual on one side of the door to prevent the mechanism allowing the door to open in the opposite direction. Moreover, the system can be implemented compactly without significant aesthetic impact.

The system does not require the locking element to engage with the frame of the door or the floor and can be implemented in an already existing door frame to minimise the amount of required retrofitting. Furthermore, the attachment of the first hinge member to the frame of the door mounting system ensures a stronger system to that of the doorpost system of the prior art.

In a preferred aspect, the locking element may selectively couple the intermediate hinge member and the second hinge member. The rotation of the second hinge member relative to the intermediate hinge member is selectively prevented while the rotation of the intermediate hinge member relative to the first hinge member is not prevented. The rotation of the second hinge member relative to the first hinge member, and therefore the door frame that the first hinge member is attached to, may comprise the normal functioning of the door. When the locking member is disengaged, the now allowed rotation of the second hinge member relative to the intermediate rotation member can result in lateral movement of the door leaf, this may allow the door leaf to clear the jamb and consequently open in a direction not otherwise available.

A first hinge pin may be provided to rotatably couple the first hinge member to the intermediate hinge member. The first hinge pin may be provided on the first hinge axis. The first hinge member and/or the intermediate hinge member may comprise a tubular pin-receiving inner sleeve for receiving the first hinge pin. In a preferred aspect, the first hinge member and the intermediate member may comprise a plurality of axially aligned and spaced apart tubular pin-receiving inner sleeves. The first hinge member and/or the intermediate member may comprise at least one concave surface, configured to receive a respective sleeve of the other of the first member or intermediate member. The inner sleeve or inner sleeves of the first hinge member and the intermediate hinge member may interdigitate coaxially to receive the first hinge pin.

A second hinge pin may be provided to rotatably couple the second hinge member to the intermediate hinge member. The second hinge pin may be provided on the second hinge axis. The second hinge member and/or the intermediate hinge member may comprise at least one tubular pin-receiving outer sleeve for receiving the second hinge pin. In a preferred aspect, the second hinge member and the intermediate member may comprise a plurality of axially aligned and spaced apart tubular pin-receiving outer sleeves. The second hinge member and/or the intermediate member may comprise at least one concave surface, configured to receive a respective outer sleeve of the other of the first member or intermediate member. The outer sleeve or outer sleeves of the second hinge member and the intermediate hinge member may interdigitate coaxially to receive the second hinge pin.

In this way, rotation around the first hinge axis and second hinge axis can effectively and reliably be provided. The system may be used safely without fear of injury due to fingers being caught due to the hinge assembly containing no gaps and having no surfaces coming together. This is especially advantageous in mental institutions where the lack of gaps prevents suicide attempts involving threading a ligature through a gap in or around a door hinge. The multiple sleeves and so hinge connections may provide a strong door hinge.

Each hinge member of the first and second hinge members may comprise a mounting element that the inner or outer sleeve or sleeves are attached to, comprising a flat surface for attachment to the door frame or door leaf respectively, said surface facing away from the intermediate hinge member. The first and second hinge members can be easily and strongly secured to the door or the door frame.

The hinge members may be each formed integrally. The hinge members may be formed from aluminium, steel or rigid plastics material. The hinge members may be formed by extrusion. The system is easy to manufacture in bulk to high tolerance levels.

The first and second hinge members may be formed symmetrically about a plane that joins the first hinge axis and the second hinge axis. The intermediate hinge member may be formed symmetrically about the plane that joins the first hinge axis and the second hinge axis. The functionality of the system may be provided in a smooth and reliable fashion.

The intermediate hinge member may comprise both inner and outer sleeves, wherein the inner and outer sleeves are situated opposite each other in the direction of the plane that joins the first hinge axis and the second hinge axis. In an alternative embodiment, the intermediate hinge member may comprise both inner and outer sleeves, wherein the inner and outer sleeves are situated opposite each other in the direction of the plane that joins the two axes of the first and second hinge members but offset in the direction of the first hinge axis or the second hinge axis.

The first and second hinge members may be formed with their pin-receiving sleeves closely adjacent the mounting element and the intermediate hinge member is formed with its pin-receiving sleeves separated by an integral web.

The locking element may be fixed to the second hinge member. The locking member may extend through the second hinge axis. This ensures a strong coupling between the second hinge member and the intermediate hinge member when the locking member is engaged.

As mentioned above, the system of the first aspect may find utility as part of a door assembly, and according to a second aspect there is provided a door assembly comprising the system of the first aspect. There may be provided a door leaf coupled to the second hinge member. Preferred and optional features of the first aspect may equally apply to the second aspect.

The door frame may comprise a door jamb, the door jamb being adjacent to an overhang of the door leaf when the locking element is selectively inhibiting rotation between the intermediate hinge member and either the first hinge member or the second hinge member, and wherein when the coupled hinge members are decoupled through disengaging the locking element and so can rotate relative to each other, the lateral movement produced by such rotation exceeds the extent of the overhang. In this way, lateral movement produced by such rotation can remove the overlap of the door jamb and the door leaf, enabling the door leaf to open in either direction.

The locking element may be part of a locking mechanism that is kept in the door leaf and holds the locking element until it is activated and moved into the hinge assembly. The system does not require the locking mechanism to engage with the frame of the door or the floor and can be implemented in an already existing door frame to minimise the amount of required retrofitting. Moreover, the system minimises the aesthetic impact and decreases the chance of injury due to catching body parts on any external parts.

The axis of the first hinge member, centre line of the intermediate hinge member and the axis of the second hinge member may all be positioned on the plane that joins the first hinge axis and the second hinge axis, which when in the first position may also be on the centre line of the door leaf. This has the advantage of resulting in a strong system and minimises the required overhang of the door jamb. This makes the system easier to retrofit into an existing door frame.

BRIEF DESCRIPTION OF THE FIGURES

A preferred embodiment will now be described with reference to the accompanying figures, in which:

FIG. 4*a* is an illustration of the normal operation of the door.

FIG. 4*b* is an illustration of the special operation of the door.

DETAILED DESCRIPTION

Figure 1:
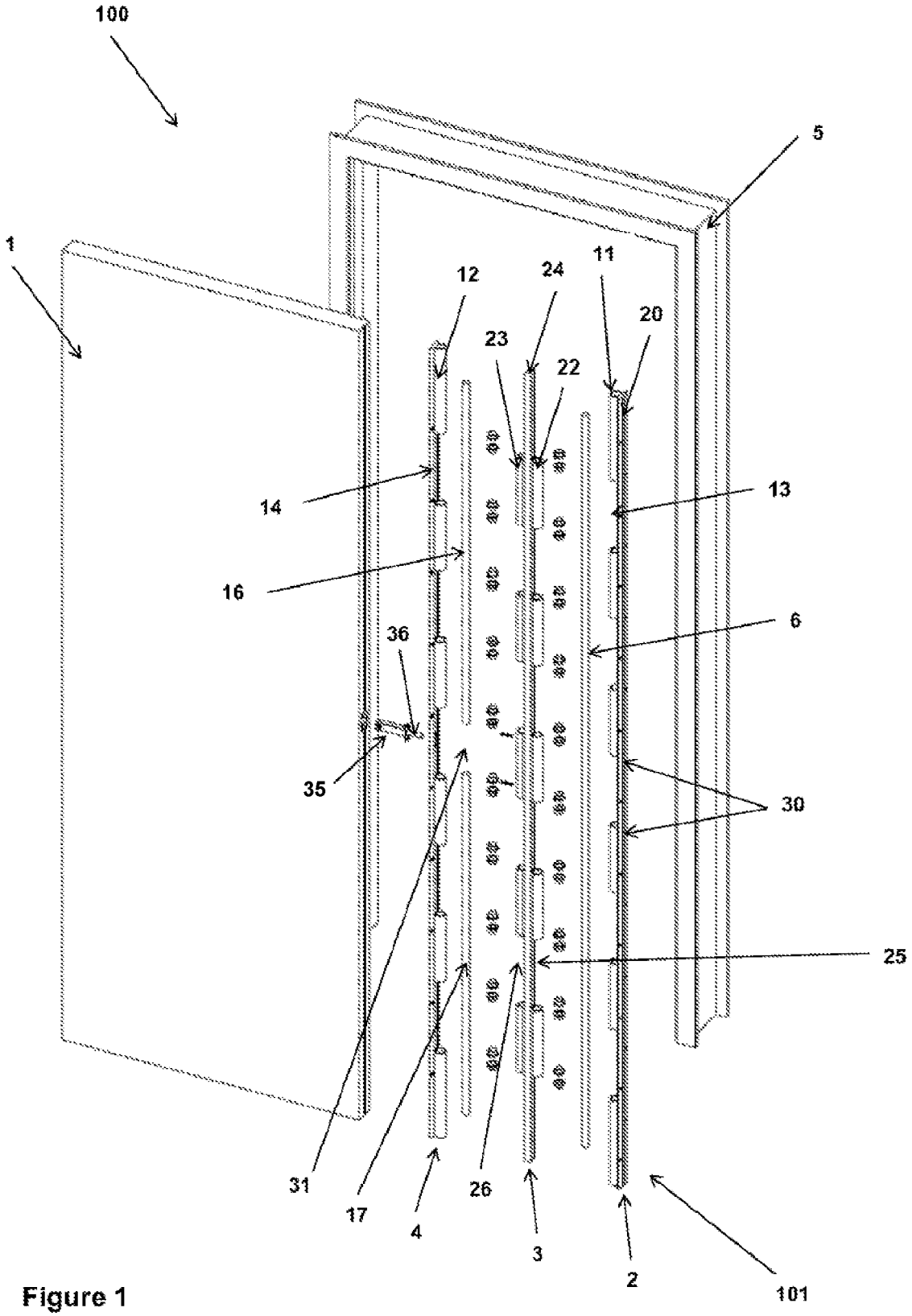
FIG. 1 is an exploded view of the door assembly.
Figure 2:
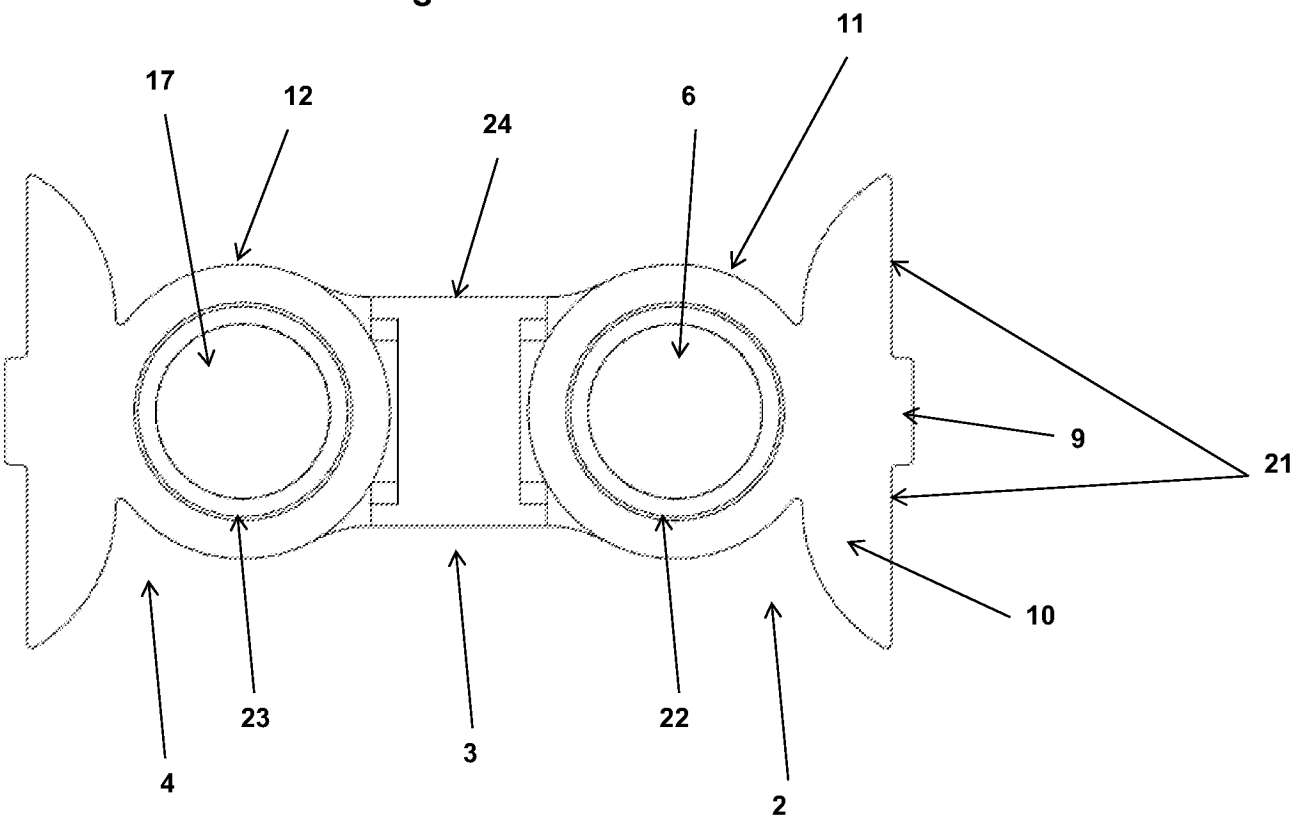
FIG. 2 is an illustration of the hinge assembly.

Referring to FIGS. 1 and 2, a preferred embodiment of a door assembly 100 is shown. The door assembly 100 comprises a hinge assembly 101 coupled to a door leaf 1 and a door frame 5.

Referring to FIGS. 1 and 2, a preferred embodiment of the hinge assembly 101 is shown. The hinge assembly 101 comprises a first hinge member 2 and a door frame 5 joined to the first hinge member 2. The door frame 5 is coupled to an outer face 20 of the mounting element 10, and this coupling may be secured by a locking ridge 9 of the first hinge member 2. The first hinge member 2 defines a first hinge axis.

The locking ridge 9 ensures that the first hinge member 2 is attached properly and is symmetrical about the centre line of the door frame 5. The coupling between the mounting element 10 and the door frame 5 may be further secured by the use of screws, nails or some other attachment that connects the mounting element 10 to the door frame 5. The screws nails or some other attachment could be inserted through holes 30. Alternatively, adhesive could be used to aid the coupling.

The first hinge member 2 is preferably made of integrally extruded aluminium, although steel or other metal or rigid plastic material may be used, and any suitable manufacturing process used. The first hinge member 2 preferably comprises a plurality of axially aligned and spaced apart tubular pin-receiving inner sleeves 11 and a plurality of inner concave surfaces 13. Preferably the inner sleeves 11 and inner concave surfaces 13 are alternating and equal in length. The inner concave surfaces 13 are preferably part-cylindrical but could be a variety of shapes.

Alternatively, the first hinge member 2 could comprise a single tubular pin-receiving inner sleeve 11 and a single inner concave surface 13.

Alternatively, the inner sleeve 11 could not be tubular in shape, but rather could be any appropriate shape.

On the side opposite the sleeve sections 11, the first hinge member 2 comprises a mounting element 10. The mounting element 10 comprises continuous flat surfaces 21 on either side of the locking ridge 9. Screw holes are formed along both sides of the mounting element 10 at regular intervals, to secure the mounting element 10 to the door frame 5.

The length of the mounting element 10 corresponds to the height of the door frame 5, although alternatively a desired level of clearance could be left under the top of the door frame 5 and/or above the floor beneath the door frame 5. Preferably, the inner sleeves 11 of the first hinge member 2 will be situated closely adjacent the mounting element 10.

The hinge assembly 101 further comprises a second hinge member 4. The second hinge member 4 is joined to the door leaf 1 in much the same way as the first hinge member 2 was joined to the door frame 5. The second hinge member 4 defines a second hinge axis.

The second hinge member 4 is much the same as the first hinge member 2 but comprises a plurality of axially aligned and spaced apart tubular pin-receiving outer sleeves 12 and a plurality of outer concave surfaces 14 rather than inner sleeves and inner concave surfaces. The difference in the nomenclature is for the purpose of clarity, there is no difference between an inner sleeve 11 or an outer sleeve 12, or between an inner or outer concave surface. Alternatively, there could be a difference between the inner and outer sleeves and between the inner and outer concave surfaces if desired.

Preferably, the first hinge member 2 and the second hinge member 4 are both formed symmetrically about the plane that joins the first hinge axis and the second hinge axis. This ensures that the rotation of the first hinge member 2 and the second hinge member 4 will be smooth and reliable.

Preferably, the first and second hinge members are identical with the inner sleeves 11 and outer sleeves 12 of the first and second hinge members aligned opposite each other. Alternatively, the inner and outer sleeves could be offset in the direction of the first or second hinge axis.

The hinge assembly 10 further comprises an intermediate hinge member 3. The intermediate hinge member 3 comprises an integral web 24. On the side of the integral web 24 closest to the first hinge member 2, the intermediate hinge member 3 comprises a plurality of axially aligned and spaced apart tubular pin-receiving intermediate inner sleeves 22 and a plurality of intermediate inner concave surfaces 25. Preferably the intermediate inner sleeves 22 and intermediate inner concave surfaces 25 are alternating and equal in length. The intermediate inner concave surfaces 22 are preferably part-cylindrical but could be a variety of shapes.

Alternatively, the intermediate hinge member 3 could comprise a single tubular pin-receiving intermediate inner sleeve 22 and a single intermediate inner concave surface 25.

Alternatively, the intermediate inner sleeve 22 could not be tubular in shape, but rather could be any appropriate shape.

On the side of the integral web 24 closest to the second hinge member 4, the intermediate hinge member 3 comprises a plurality of axially aligned and spaced apart tubular pin-receiving intermediate outer sleeves 23 and a plurality of intermediate outer concave surfaces 26. Preferably the intermediate outer sleeves 23 and intermediate outer concave surface 26 are alternating and equal in length. The intermediate outer concave surfaces 26 are preferably part-cylindrical but could be a variety of shapes.

Alternatively, the intermediate hinge member 3 could comprise a single tubular pin-receiving intermediate outer sleeve 23 and a single intermediate outer concave surface 26.

Preferably, the intermediate inner sleeves 22 and the intermediate outer sleeves 23 are opposite each other on either side of the integral web 24 in the direction of the plane that joins the first hinge axis and the second hinge axis, and are aligned at the same height. Alternatively, the intermediate inner sleeves 22 and the intermediate outer sleeves 23 are opposite each other on either side of the integral web 24 but offset in the direction of the first or second hinge axis.

Preferably, the intermediate inner concave surfaces 25 and the intermediate outer concave surfaces 26 are opposite each other on either side of the integral web 24 in the direction of the plane that joins the first hinge axis and the second hinge axis, and are aligned at the same height. Alternatively, the intermediate inner concave surfaces 25 and the intermediate outer concave surfaces 26 are opposite each other on either side of the integral web 24 but offset in the direction of the first or second hinge axis.

Preferably, the intermediate hinge member 3 is formed symmetrically about the plane that joins the first hinge axis and the second hinge axis. This ensures that any rotation in the system will be smooth and reliable.

The intermediate hinge member 3 is rotatably coupled to the first hinge member 2 and the second hinge member 4.

The intermediate inner sleeves 22 of the intermediate hinge member 3 interdigitates coaxially with the inner sleeves 11 of the first hinge member. The outer surfaces of the intermediate inner sleeves 22 will be against the inner concave surfaces 13 of the first hinge member 2, and the outer surfaces of the inner sleeves 11 of the first hinge member 2 will be against the intermediate inner concave surfaces 25 of the intermediate hinge member 3. Preferably, just enough clearance is left between the inner sleeves 11 and the intermediate inner sleeves 22 to allow for rotation of the first hinge member 2 relative to the intermediate hinge member 3 around the first hinge axis. Alternatively, any desired clearance could be left. Inner hinge pin 6 passes through the aligned sleeves over the length of the hinge to secure the two hinge members together. Inner hinge pin 6 will preferably have almost the same outer diameter as the inner diameter of the inner sleeves 11 and intermediate inner sleeves 22. Alternatively, inner hinge pin 6 may have any outer diameter smaller than the inner diameter of the inner sleeves 11 and intermediate inner sleeves 22. Alternatively, the inner hinge pin 6 can be any desired length.

Figure 5:
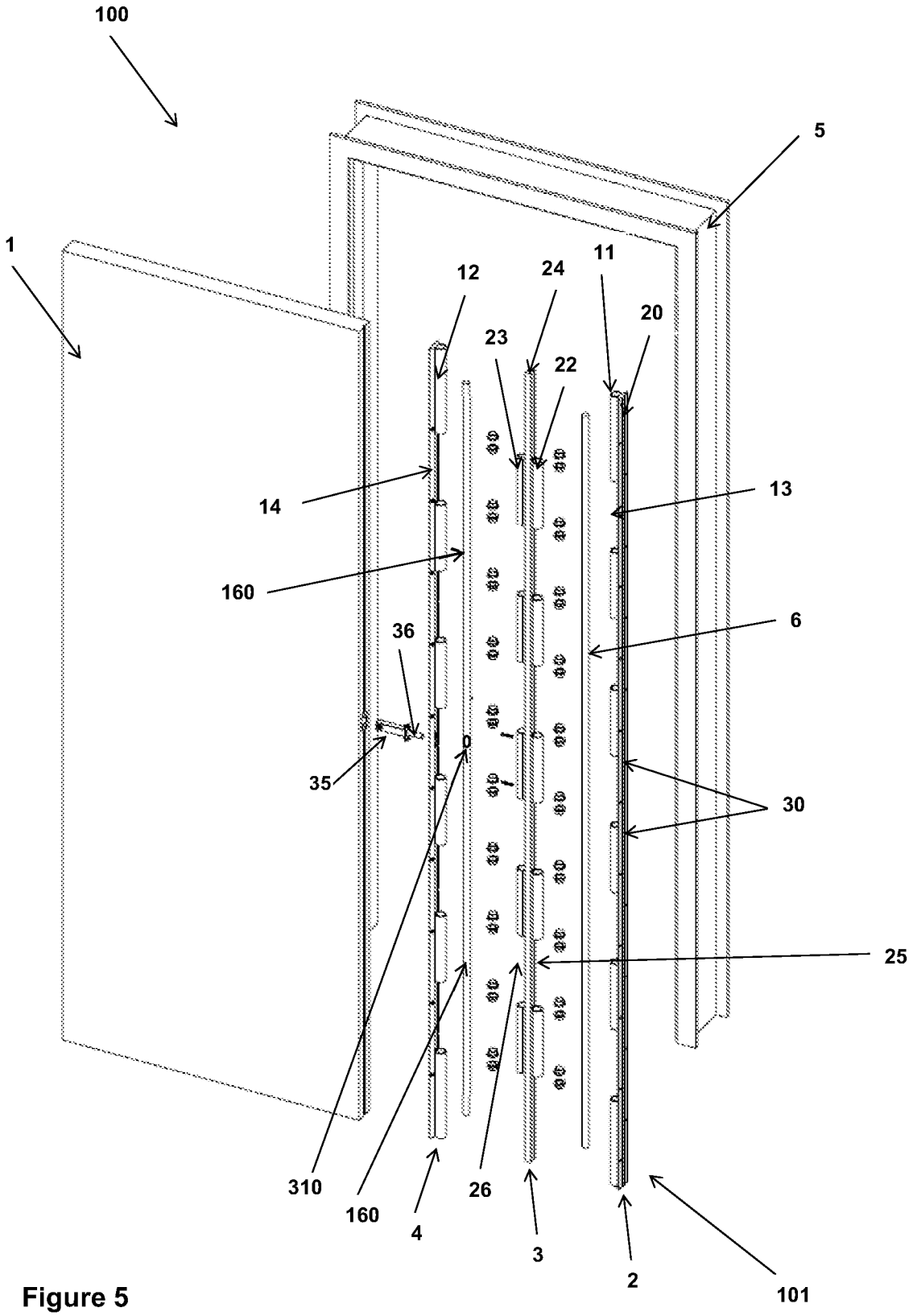
FIG. 5 is an exploded view of a second embodiment of the door assembly.

The intermediate outer sleeves 23 of the intermediate hinge member 3 will interdigitate coaxially with the outer sleeves 12 of the second hinge member 4 in a similar way, using an outer hinge pin formed of two outer hinge pin parts 16 and 17 to secure the two hinge members together. Preferably a gap 31 will exist between the outer hinge pin parts 16 and 17. Alternatively, the outer hinge pin parts 16 and 17 could comprise one long hinge pin 160 with a hole 310 situated to allow the locking element to pass through or into, as shown in FIG. 5.

The interdigitating sleeves of the respective hinge members may extend continuously in the manner of a piano hinge, over substantially the full height of the door. This results in a strong connection between the different hinge members and between the door leaf and the door frame.

Figure 3C:
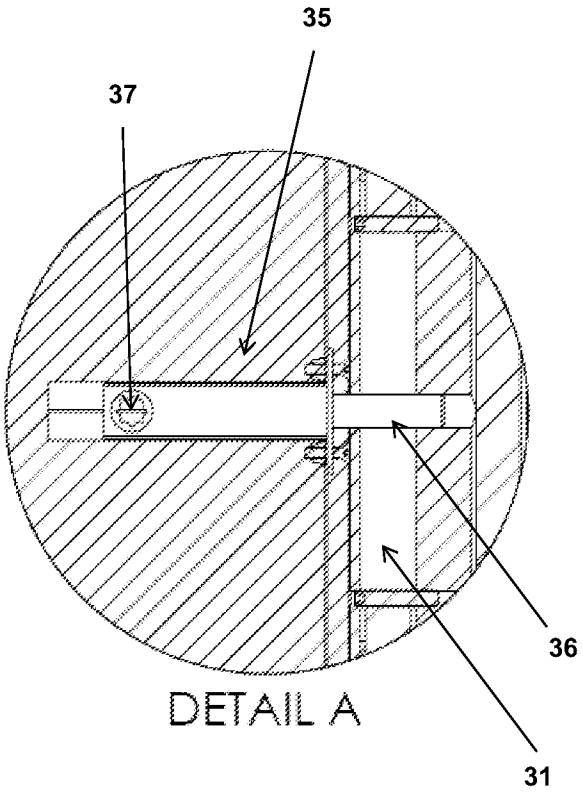
FIG. 3*c* is an illustration of the locking mechanism.
Figure 3B:
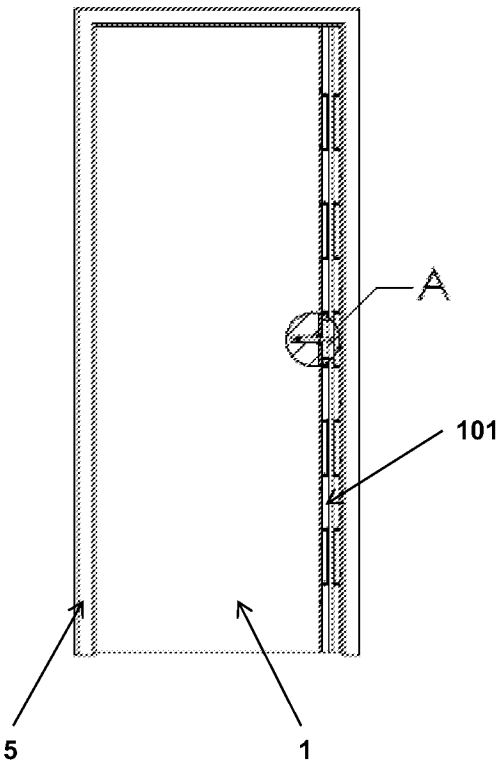
FIG. 3*b* is an illustration of the door assembly including the locking mechanism.
Figure 3A:
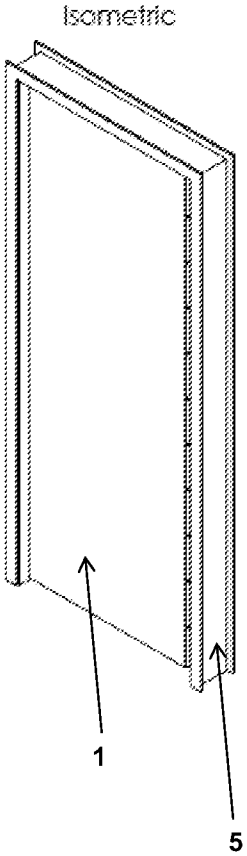
FIG. 3*a* is an illustration of the door assembly.

FIGS. 3*a* and 3*b* show the door assembly 100 in various views.

With reference to FIGS. 1 and 3*c*, a locking mechanism 35 is shown in a preferred embodiment. The locking mechanism 35 comprises a locking element 36 that selectively couples the intermediate hinge member 3 to the second hinge member 4. Preferably, the locking mechanism 35 is kept in the door leaf 1 and is fixed to the second hinge member 4. When engaged, the locking element 36 extends through the second hinge axis, into gap 31, thereby preventing rotation of the second hinge member 4, and so door leaf 1, around the second hinge axis. The intermediate outer sleeve 23 at this point may include one or more openings to receive the locking element 36.

Alternatively, the locking element 36 selectively couples the intermediate hinge member 3 to the first hinge member 2.

In preferred embodiments, the door leaf 1 comprises a through hole 37 to enable actuation of the locking element 36. This may be the only external indication to identify the mechanism. In this manner, the functionality of the system can be provided discreetly.

Operation of the door assembly 100 of the preferred embodiment can be understood with reference to FIGS. 4*a* and 4*b*. FIG. 4*a* shows the door assembly 100 in a closed position during normal operation. Rotation of the door leaf 1 around the second hinge axis is prevented due to the engagement of the locking element 36 and so coupling of the second hinge member 4 and the intermediate hinge member 3. The door can still open in either direction due to rotation around the first hinge axis, i.e. the rotation of the intermediate hinge member 3 relative to the first hinge member 2.

In this position, the door jamb 38 interacts with overhang 39 of the door leaf 1 to prevent the door being opened in a given direction of rotation. However, the door jamb 38 does not prevent operation of the door in the opposite direction. The door thus operates as a one way door. For example, the door assembly may be provided for the doorway to a private room off a corridor in a mental institution in normal operation, the door opens inwardly into the private room but cannot open outwardly into the corridor.

There may be circumstances in which it is desirable to open the door outwardly into the corridor. For example, a patient may require treatment but have barricaded the door against inward opening. In these circumstances, an operator may use a key to disengage the locking element 36. This causes the locking element 36 to retract back into the door leaf 1. Any appropriate mechanism for retracting the locking element 36 could be used.

The disengagement of the locking element 36 allows for rotation of the second hinge member 4 relative to the intermediate hinge member 3, around the second hinge axis. As shown in the switched operation in FIG. 4*b*, this particularly allows for rotation of the second hinge member 4 around the intermediate hinge member 3 in the same direction as the normal opening direction of the door at the same time as rotation of the intermediate hinge member 3 relative to the first hinge member 2 in a direction opposite to the normal opening direction of the door.

Pulling the door leaf 1 outwards, in a direction opposite to the normal opening direction of the door, will lead to these two rotations being performed simultaneously.

This results in the door leaf 1 moving laterally. As can be seen in FIG. 4*b*, the relative movement of the door leaf 1 and the door frame 5 means that the door jamb 38 no longer inhibits outward opening of the door leaf 1. The door can now be opened outwardly to safely access the room behind via rotation of the second hinge member 4 relative to the intermediate hinge member 3 in a direction opposite to the normal opening direction of the door. This can be seen in FIG. 4*b*.

Variations and modifications will be apparent to the skilled person. Such variations and modifications may involve equivalent and other features which are already known and which may be used instead of, or in addition to, features described herein. Features that are described in the context of separate examples may be provided in combination in a single embodiment. Conversely, features which are described in the context of a single example may be also provided separately or in any suitable sub-combination.

The invention claimed is:

1. A door mounting system, comprising:

a hinge assembly and a door frame, wherein a length of the hinge assembly is approximately equal to a height of a door leaf, the hinge assembly comprising:

a first hinge member coupled to the door frame;

an intermediate hinge member, wherein the first hinge member and the intermediate hinge member are rotatably coupled to each other and are pivotable relative to each other about a first hinge axis;

a second hinge member for attachment to the door leaf, wherein the second hinge member and the intermediate hinge member are rotatably coupled to each other via a first outer hinge pin and a second outer hinge pin and are pivotable relative to each other about a second hinge axis, the first outer hinge pin and the second outer hinge pin being vertically spaced apart to define a gap therebetween; and an engageable and disengageable locking mechanism adapted to be mounted in the door leaf, the locking mechanism including a locking element slidably mounted with respect to the second hinge member and the intermediate hinge member such that the locking element is movable between a first engaged position and a second disengaged position, wherein when in the first engaged position, the locking element extends through the gap into the intermediate hinge member to inhibit rotation of the intermediate hinge member relative to the second hinge member, and wherein when the locking element is in the second disengaged position, the locking element is retracted from the intermediate hinge member and allows the rotation of the intermediate hinge member relative to the second hinge member.

2. A system according to claim 1, further comprising an inner hinge pin extending along the first hinge axis, the first hinge member and the intermediate hinge member being rotatably coupled to each other via the inner hinge pin.

3. A system according to claim 2, wherein each of the first hinge member and the intermediate hinge member comprises a plurality of axially aligned and spaced apart tubular pin-receiving inner sleeves to receive the inner first hinge pin, the plurality of inner sleeves of the first hinge member and the plurality of inner sleeves of the intermediate hinge member interdigitating coaxially.

4. A system according to claim 3, wherein the first hinge member comprises at least one concave surface, configured to receive at least one of the plurality of inner sleeves of the intermediate hinge member.

5. A system according to claim 3, wherein the intermediate hinge member comprises at least one intermediate inner concave surface, configured to receive at least one of the plurality of inner sleeves of the first hinge member.

6. A system according to claim 1, wherein each of the second hinge member and the intermediate hinge member comprises a plurality of axially aligned and spaced apart tubular pin-receiving outer sleeves to receive the first outer hinge pin and the second outer hinge pin, the plurality of outer sleeves of the second hinge member and the plurality of outer sleeves of the intermediate hinge member interdigitating coaxially.

7. A system according to claim 6, wherein the second hinge member comprises at least one concave surface, configured to receive at least one of the plurality of outer sleeves of the intermediate hinge member.

8. A system according to claim 6, wherein the intermediate hinge member comprises at least one intermediate inner concave surface, configured to receive at least one of the plurality of outer sleeves of the second hinge member.

9. A system according to claim 1, wherein at least one of the first and second hinge members comprises a mounting element, the mounting element comprising a flat surface for attachment to a respective one of the door frame or the door leaf, said surface facing away from the intermediate hinge member.

10. A system according to claim 1, wherein one or more of the first hinge member, the second hinge member, and the intermediate hinge member are each formed integrally.

11. A system according to claim 1, wherein one or more of the first hinge member, the second hinge member, and the intermediate hinge member are each formed from aluminium, steel or plastic material.

12. A system according to claim 11, wherein one or more of the first hinge member, the second hinge member, and the intermediate hinge member are each formed by extrusion.

13. A system according to claim 1, wherein each of the first and second hinge members is symmetrical about a plane that passes through the first hinge axis and the second hinge axis when the door leaf is closed.

14. A system according to claim 1, wherein the intermediate hinge member is symmetrical about a plane that passes through the first hinge axis and the second hinge axis.

15. A door assembly comprising:

a door leaf; and a hinge assembly and a door frame, wherein a length of the hinge assembly is approximately equal to a height of the door leaf, the hinge assembly comprising:

a first hinge member coupled to the door frame;

an intermediate hinge member, wherein the first hinge member and the intermediate hinge member are rotatably coupled to each other and are pivotable relative to each other about a first hinge axis;

a second hinge member coupled to the door leaf, wherein the second hinge member and the intermediate hinge member are rotatably coupled to each other via an outer hinge pin and are pivotable relative to each other about a second hinge axis, the outer hinge pin having a hole for receiving a locking element therethrough; and an engageable and disengageable locking mechanism mounted in the door leaf, the locking mechanism including the locking element slidably mounted with respect to the second hinge member and the intermediate hinge member such that the locking element is movable between a first engaged position and a second disengaged position, wherein when in the first engaged position, the locking element extends through the hole into the intermediate hinge member to inhibit rotation of the intermediate hinge member relative to the second hinge member, and wherein when the locking element is in the second disengaged position, the locking element is retracted from the intermediate hinge member and allows the rotation of the intermediate hinge member relative to the second hinge member.

16. A door mounting system, comprising:

a hinge assembly and a door frame, wherein a length of the hinge assembly is approximately equal to a height of a door leaf, the hinge assembly comprising:

a first hinge member coupled to the door frame;

an intermediate hinge member, wherein the first hinge member and the intermediate hinge member are rotatably coupled to each other and are pivotable relative to each other about a first hinge axis;

a second hinge member for attachment to the door leaf, wherein the second hinge member and the intermediate hinge member are rotatably coupled to each other via an outer hinge pin and are pivotable relative to each other about a second hinge axis, the outer hinge pin having a hole for receiving a locking element therethrough; and an engageable and disengageable locking mechanism adapted to be mounted in the door leaf, the locking mechanism including the locking element slidably mounted with respect to the second hinge member and the intermediate hinge member such that the locking element is movable between a first engaged position and a second disengaged position, wherein when in the first engaged position, the locking element extends through the hole into the intermediate hinge member to inhibit rotation of the intermediate hinge member relative to the second hinge member, and wherein when the locking element is in the second disengaged position, the locking element is retracted from the intermediate hinge member and allows the rotation of the intermediate hinge member relative to the second hinge member.

17. A system according to claim 16, further comprising an inner hinge pin extending along the first hinge axis, the first hinge member and the intermediate hinge member being rotatably coupled to each other via the inner hinge pin.

18. A system according to claim 17, wherein each of the first hinge member and the intermediate hinge member comprises a plurality of axially aligned and spaced apart tubular pin-receiving inner sleeves to receive the inner hinge pin, the plurality of inner sleeves of the first hinge member and the plurality of inner sleeves of the intermediate hinge member interdigitating coaxially.

19. A system according to claim 16, wherein each of the second hinge member and the intermediate hinge member comprises a plurality of axially aligned and spaced apart tubular pin-receiving outer sleeves to receive the outer hinge pin, the plurality of outer sleeves of the second hinge member and the plurality of outer sleeves of the intermediate hinge member interdigitating coaxially.

20. A system according to claim 16, wherein at least one of the first and second hinge members comprises a mounting element, the mounting element comprising a flat surface for attachment to a respective one of the door frame or the door leaf, said surface facing away from the intermediate hinge member.

* * * * *